US006675411B1

(12) United States Patent
Javier

(10) Patent No.: US 6,675,411 B1
(45) Date of Patent: Jan. 13, 2004

(54) METHOD OF MOVING A PATIENT LATERALLY

(75) Inventor: Victoria Guzman Javier, Canyon Country, CA (US)

(73) Assignee: Sandel Medical Industries LLC, Chatsworth, CA (US)

( * ) Notice: Subject to any disclaimer, the term of this patent is extended or adjusted under 35 U.S.C. 154(b) by 0 days.

(21) Appl. No.: 10/238,793

(22) Filed: Sep. 10, 2002

(51) Int. Cl.[7] ..... A61G 7/08
(52) U.S. Cl. ..... 5/81.1
(58) Field of Search ..... 5/81.1 HS, 81.1 T, 5/81.1 R, 81.1 C

(56) References Cited

U.S. PATENT DOCUMENTS 4,051,565 A * 10/1977 Berge ..... 5/81.1 C
4,944,053 A * 7/1990 Smith ..... 5/81.1 T
5,005,232 A * 4/1991 Wright et al. ..... 5/81.1 C
5,148,558 A * 9/1992 Dunn ..... 5/81.1 T
6,012,183 A * 1/2000 Brooke et al. ..... 5/81.1 HS
6,374,435 B1 * 4/2002 Leininger et al. ..... 5/81.1 HS
6,467,106 B1 * 10/2002 Heimbrock ..... 5/81.1 HS

FOREIGN PATENT DOCUMENTS

GB 2159047 A * 11/1985 ..... 5/81.1 HS

* cited by examiner

*Primary Examiner*—Alexander Grosz
(74) *Attorney, Agent, or Firm*—Perkins Coie LLP

(57) ABSTRACT

A method of laterally moving a patient lying on a sheet comprises the steps of: rolling the patient on one shoulder by lifting on the sheet adjacent to the other shoulder; positioning a flattened hollow tube having open ends beneath the patient and the sheet, the flattened hollow tube forming a rectangular endless carrier including a conveying layer, a return layer, and side edges, the side edges joining the conveying layer and the return layer; rolling the patient back onto the flattened hollow tube by lowering the sheet; and laterally displacing the patient and causing the flattened hollow tube to roll by horizontally pulling on the sheet in a direction perpendicular to the side edges.

7 Claims, 3 Drawing Sheets

METHOD OF MOVING A PATIENT LATERALLY

BACKGROUND OF THE INVENTION

The field of the invention is methods and apparatus for moving a patient, and in particular, a patient laying in a generally horizontal position.

Providing medical care requires patients to be frequently transported. Wheelchairs are used where possible, but when a patient is, for example, postoperative or unconscious, stretchers or gurneys must be used to move the patients while in the horizontal or lying position.

Transferring patients from a bed or operating table onto a gurney, or from a gurney onto a bed or operating table, depending on the size and condition of the patient and that of the nurse or other health care professional, can be a difficult task. Frequently, the patient's medical condition prevents the nurse from directly lifting the patient. Therefore, to transfer the patient onto a gurney, a bed or an operating table, nurses typically grab the draw sheet beneath the patient and lift or slide the patient. However, this may cause the patient discomfort if the draw sheet slips from the nurse's grasp. Moreover, generally two or more nurses are needed to move a patient in this way. Heavy patients are especially difficult to move by pulling on the draw sheet.

Accordingly, it is an object of the invention to provide improved methods and apparatus for moving a patient between a bed, gurney, table or other horizontal surface.

SUMMARY OF THE INVENTION

In a first aspect of the invention, a patient transfer device includes a flat hollow tube having open ends., The tube can roll or slide on itself. The tube reduces sliding friction when moving a patient. A lubricant is optionally provided on the inside surface of the tube to reduce sliding friction.

In a second aspect, a flattened hollow tube having open ends is provided under the patient and the draw sheet. The draw sheet is pulled to move the patient. The tube reduces sliding friction between the draw sheet and the bed sheet. The patient can therefore be more easily pulled from one bed, gurney, or table onto another.

In a third aspect, tubes are provided on a roll, similar to the plastic fruit and vegetable bags provided in supermarkets. A seam having perforations connects each tube on the roll with adjacent tubes. The tubes may be quickly and easily pulled off the roll, as needed.

The tubes, either on the roll, or packaged individually, may optionally be sterilized.

The invention resides as well in subcombinations of the features and steps described.

BRIEF DESCRIPTION OF THE DRAWINGS

Other objects and features will become apparent from the following detailed description taken in connection with the accompanying drawings. However, the drawings are provided for purpose of illustration only, and are not intended as a definition of the limits of the invention.

In the drawings, wherein the same reference number indicates the same element throughout the several views.

DETAILED DESCRIPTION OF THE DRAWINGS

Figure 1:
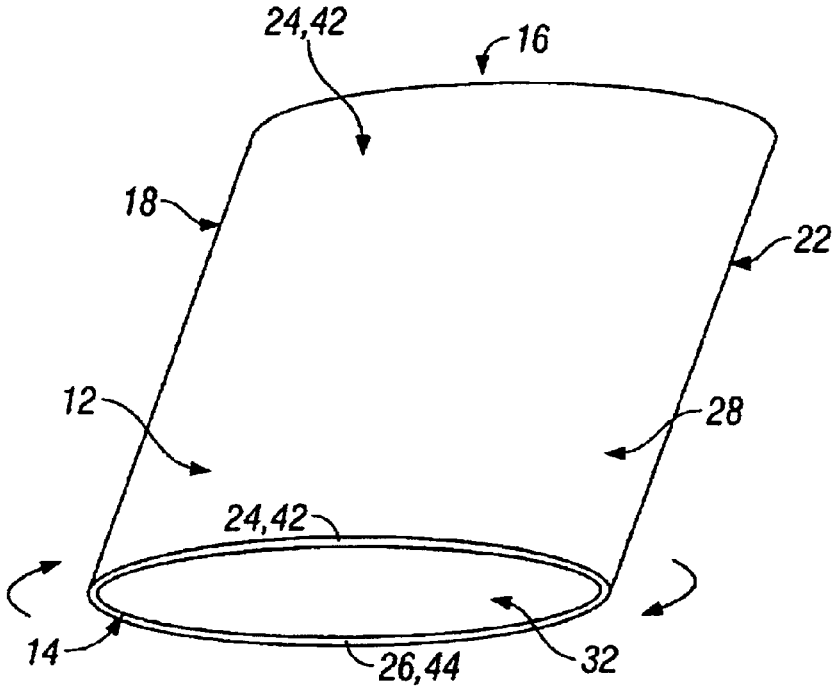
FIG. 1 is a perspective view of the present patient transferring device.
Figure 2:
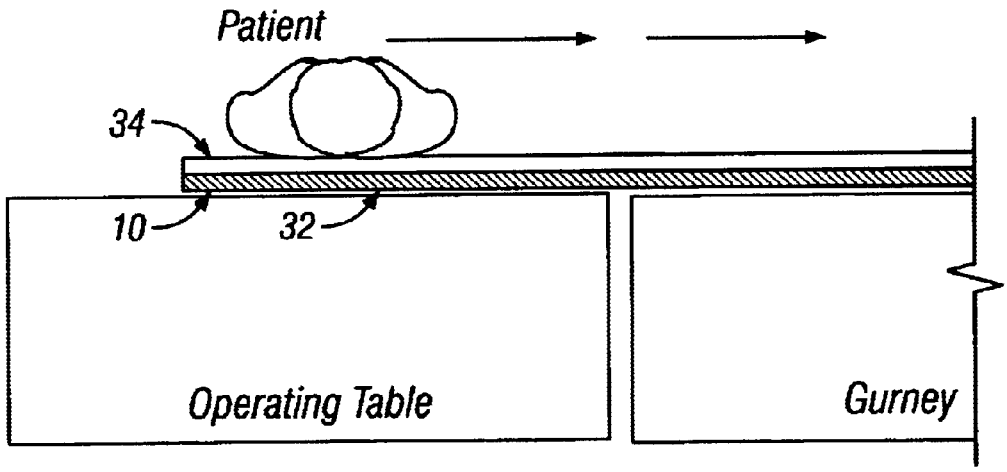
FIG. 2 is an end view of the patient transferring device of FIG. 1 under a draw sheet.

Turning now in detail to the drawings, as shown in FIGS. 1 and 2, the patient transferring device 10 is preferably a hollow tube 12 having open ends 14, 16. When laid flat on a bed, the tube 12 is advantageously rectangular. The ends 14, 16 of the tube are open, while the sides or edges 18, 22 are generally perpendicular to the open ends. The tube 12 is a continuous or endless surface. For purpose of explanation, the tube can be characterized as having a top layer 24 and a bottom layer 26 connected to each other at the edges 18, 22. The top layer 24 lays on top of the bottom layer 26. Preferably, the tube 12 is symmetrical thereby forming a top layer 24 and a bottom layer that are equally sized and rectangular in shape.

The patient transferring device 10 is preferably made from polyethylene or other suitable flexible material preferably having a low friction coefficient. The material should also be acceptable for use in a sterile environment such as an operating room. Due to the low friction coefficient, the top layer 24 can easily slide against or roll over the bottom layer. To further reduce the friction between the layers, the inside surface 32 of the flattened hollow tube 12 may be treated with powder or dry lubricant or other suitable friction reducing material. The patient transferring device 10 may also have anti-static treatment to reduce or eliminate accumulation of electrostatic charge.

Although the patient transferring device 10 is shown in FIGS. 1 and 2 as having a gap between the top layer 24 and bottom layer 26, this is for illustration purposes only. The inside surfaces of the top layer 24 and bottom layer 26 are typically largely in contact with each other. While open ends are preferred, to facilitate rolling or sliding movement, a tube having one or both ends closed may also be used.

The patient transferring device 10 may vary in size, shape and thickness. Preferably, the device 10 has a rectangular shape 30–50; 35–45 or 40 inches long and 20–40; 25–35; or 30 inches wide. The thickness of the tube material is preferably 0.001–0.010; 0.002–0.006; 0.003–0.005; or 0.004 inches.

Figure 3:
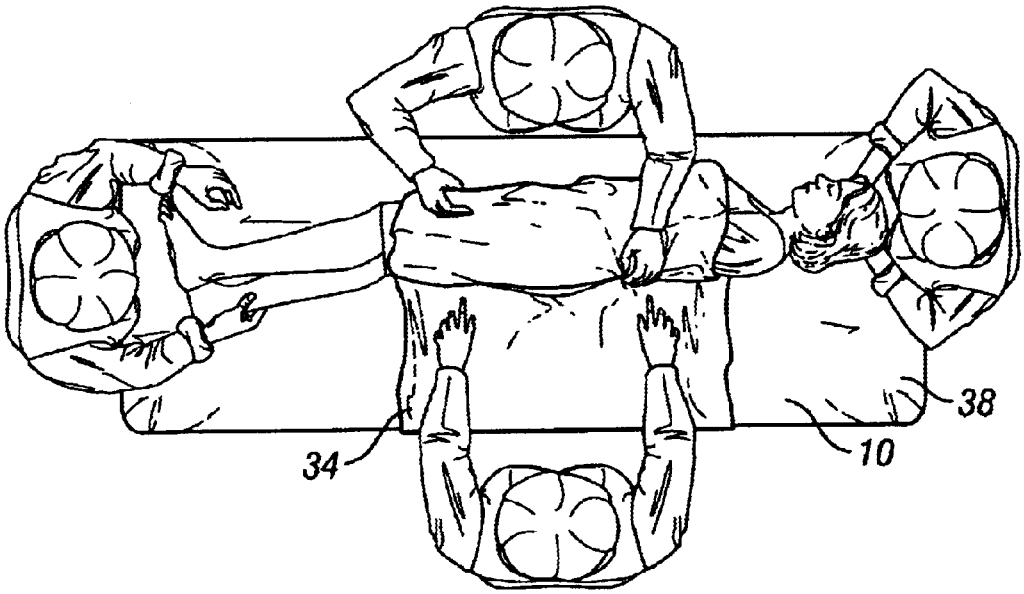
FIG. 3 is a top view of a patient lying on a sheet on a table and the patient transferring device of FIG. 1.

In use, the patient transferring device 10 is positioned beneath a patient to be transferred. A preferred method to position the device 10 beneath the patient will now be described. Referring to FIG. 3, a patient is shown on a draw sheet 34 on a bed or operating table or other surface 38. The patient is rolled on his first shoulder by lifting on the draw sheet 34 adjacent his second shoulder. While in this position, the device 10 is placed beneath the patient and the draw sheet 34 with the open ends 14, 16 facing the patient's head and feet, respectively. For purposes of explanation here, the top layer 24 is referred to as the conveying layer 42 and the bottom layer 26 is referred to as the return layer 44, as shown in FIG. 2. The device 10 is positioned with the conveying layer 42 facing up and the return layer 44 facing down on the table. Next, the patient is lowered onto the conveying layer 42 of device 10 by lowering the draw sheet 34 adjacent the patient's second shoulder. (Although the device 10 is preferably a continuous uniform loop or ring of material, with no permanent "layers" or "sides," a clearer description of the device 10 and its use is provided using these terms.)

Figure 4:
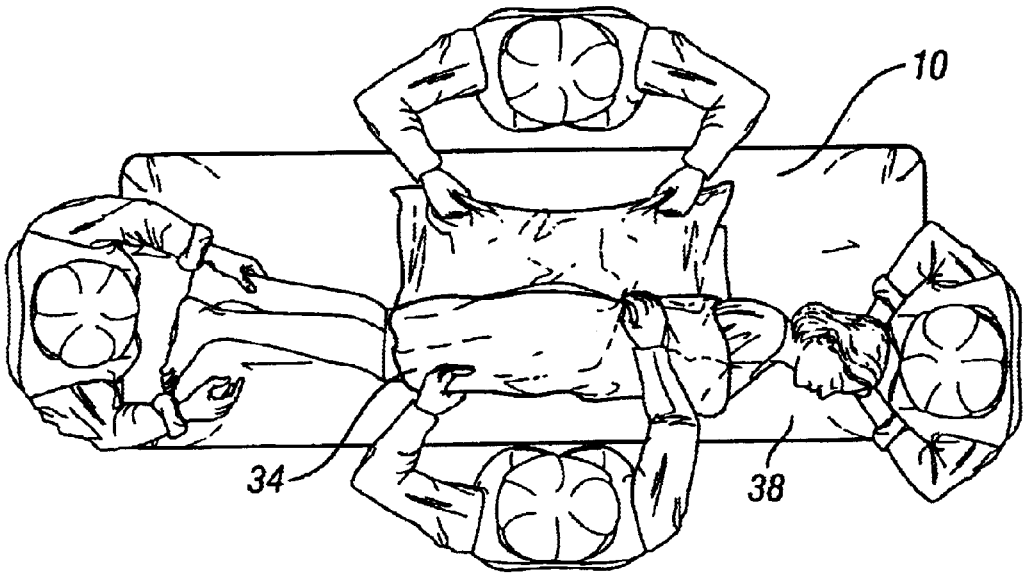
FIG. 4 is a top view of the patient in FIG. 3 with the patient transferring device positioned beneath.

Referring to FIG. 4, the patient is then rolled over to his second shoulder and onto the device 10 by lifting on the draw sheet 34 adjacent his first shoulder. The patient is then laying completely on the conveying layer 42 of device 10. Lifting the draw sheet 34 adjacent the patient's first shoulder also causes the patient's weight to shift, which tends to laterally move the patient towards his second shoulder. When the patient is then rolled back, the device generally is completely under the patient. The nurse may also lightly pull horizontally on the draw sheet 34 adjacent to the patient's second shoulder, while the patient is rolled on his second shoulder, to further achieve this lateral movement. In this way, the patient transferring device 10 is placed beneath the patient lying on his back. The device 10 of course also may be positioned beneath the patient in other ways. For example, the device 10 may simply be placed on the table 38 before the patient is initially moved onto the table.

Figure 5:
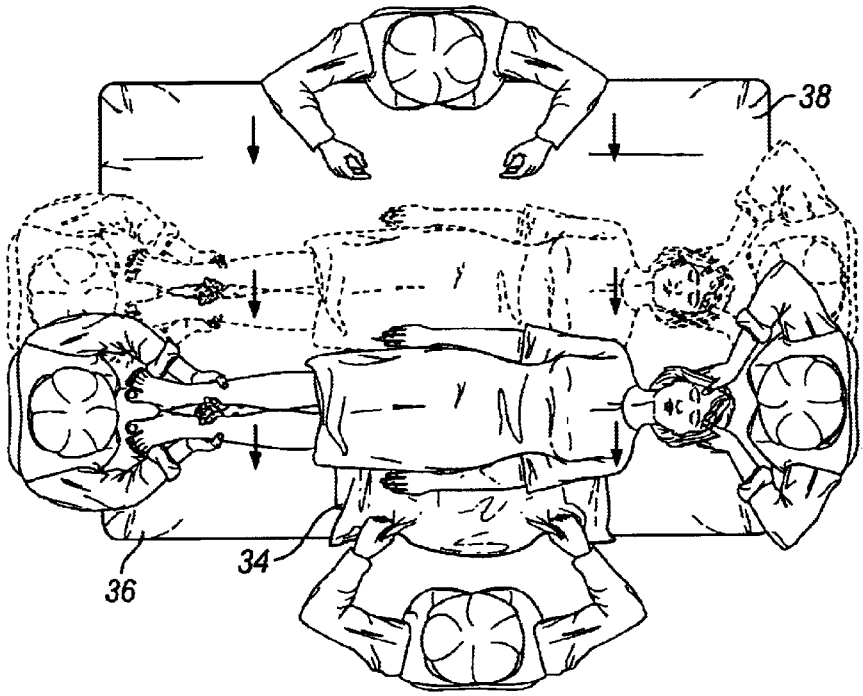
FIG. 5 is a top view of the patient in FIG. 3 being laterally transferred to an adjacent gurney.

Next, referring to FIG. 5, a second stretcher, bed, gurney, or other support surface 36 is positioned adjacent to table 38, at a height adjusted to be substantially even or level with table 38. The patient is transferred from the table 38 to the gurney 36, by pulling horizontally on the draw sheet 34 in the direction of the gurney 36. The device 10 advantageously eases the task of transferring the patient onto the gurney by reducing the friction between the patient/sheet and the table. This provides for a smooth lateral sliding movement of the patient. The device 10 forms an endless carrier, operating similar to a conveyor belt.

Referring back to FIG. 2, when the draw sheet 34 is horizontally pulled, the conveying layer 42 of the device 10 advances or rolls to become the return layer 44, while simultaneously, the return layer 44 advances to become the conveying layer 42. This results because the friction between the draw sheet 34 and the conveying layer 42 is greater than the friction between the conveying layer 42 and return layer 44. The optional lubricant between the conveying layer 42 and return layer 44 further assists in the advancing sliding movement. Due to the low friction coefficient of the device 10, the draw sheet slides over the device 10. In these ways, separately or in combination, the patient transferring device 10 effectively and easily moves the patient laterally onto the gurney 36. As less effort is required to move the patient, fewer nurses are needed. Moreover, because no lifting is required, device 10 reduces the discomfort and potential injury to the patient associated with movement among OR tables, gurneys or beds.

Figure 6:
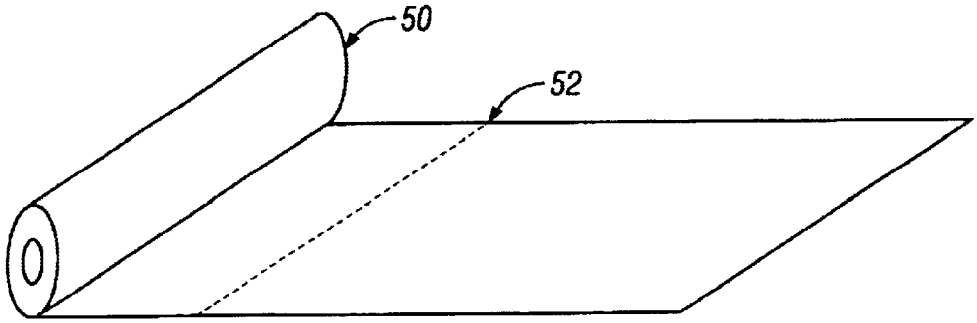
FIG. 6 is a perspective view of a roll of tubes.

As shown in FIG. 6, the tubes may advantageously be provided on a roll 50, having a large number of tubes joined at a perforation 52. As a tube is pulled off of the roll 50 at the perforation, the perforation opens, leaving a tube with open ends.

Thus, a novel patient transferring device and method has been shown and described. Various changes can, of course, be made without departing from the spirit and scope of the invention. The invention, therefore, should not be restricted, except to the following claims and their equivalents.

What is claimed is:

1. A method of moving a patient lying on a sheet comprising the steps of:

rolling the patient on a first shoulder by lifting on the sheet adjacent to a second shoulder;

laying a tube beneath the Patient and the sheet;

rolling the patient back onto the tube by lowering the sheet; and pulling on the sheet to laterally move the patient, with the tube rolling under the sheet.

2. The method of claim 1, wherein a conveying layer of the tube slides over a return layer of the tube.

3. The method of claim 1, wherein the tube is located under the patient's torso.

4. The method of claim 1 wherein the step of laying a tube beneath the patient and the sheet further includes rolling the patient on the second shoulder by lifting on the sheet adjacent to the first shoulder.

5. The method of claim 1 further including the step of laying the tube on a first surface beneath the patient and the sheet; and laterally moving the patient onto a second surface by pulling horizontally on the sheet in a direction towards the second surface, with the second surface adjacent to the first surface.

6. The method of claim 1 wherein the tube is sterile.

7. A method of laterally moving a patient lying on a sheet comprising the steps of:

rolling the Patient on one shoulder by lifting on the sheet adjacent to the other shoulder;

positioning a flattened hollow tube having open ends beneath the patient and the sheet, the flattened hollow tube forming a rectangular endless carrier including a conveying layer, a return layer, and side edges, the side edges joining the conveying layer and the return layer;

rolling the patient back onto the flattened hollow tube by lowering the sheet; and laterally displacing the patient and causing the flattened hollow tube to roll by horizontally pulling on the sheet in a direction perpendicular to the side edges.

* * * * *